US011186786B2

(12) United States Patent
Al-Shammari et al.

(10) Patent No.: US 11,186,786 B2
(45) Date of Patent: Nov. 30, 2021

(54) METHOD FOR PREHEATING NAPHTHA IN NAPHTHA CATALYTIC CRACKING PROCESSES

(71) Applicant: SABIC GLOBAL TECHNOLOGIES B.V., Bergen OpZoom (NL)

(72) Inventors: Talal Al-Shammari, Riyadh (SA); Talal Aldugman, Riyadh (SA)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 16/772,154

(22) PCT Filed: Nov. 15, 2018

(86) PCT No.: PCT/IB2018/059012
§ 371 (c)(1),
(2) Date: Jun. 11, 2020

(87) PCT Pub. No.: WO2019/116122
PCT Pub. Date: Jun. 20, 2019

(65) Prior Publication Data

US 2021/0071094 A1 Mar. 11, 2021

Related U.S. Application Data

(60) Provisional application No. 62/599,557, filed on Dec. 15, 2017.

(51) Int. Cl.
*C10G 11/00* (2006.01)
*C10G 51/04* (2006.01)

(52) U.S. Cl.
CPC ..... *C10G 51/04* (2013.01); *C10G 11/00* (2013.01); *C10G 2300/1044* (2013.01);
(Continued)

(58) Field of Classification Search
CPC ... C10G 11/00–02; C10G 11/10; C10G 11/20; C10G 51/04;
(Continued)

(56) References Cited

U.S. PATENT DOCUMENTS 3,795,713 A 3/1974 Kanai et al.
4,792,436 A 12/1988 Tsai
(Continued)

FOREIGN PATENT DOCUMENTS

KR 101292923 8/2013

OTHER PUBLICATIONS

International Search Report and Written Opinion issued in International Patent Application No. PCT/IB2018/059012, dated Feb. 11, 2019.

(Continued)

*Primary Examiner* — Renee Robinson
(74) *Attorney, Agent, or Firm* — Norton Rose Fulbright US LLP

(57) ABSTRACT

A method of converting naphtha is disclosed. The method includes heating the naphtha in stages in different heating units. The naphtha is vaporized in the first heating unit. And the vaporized naphtha undergoes the largest temperature change of the process in the second heating unit. A third heating unit can be a part of the reactor. The reactor includes a catalyst which is contacted with the pre-heated naphtha to convert it to $C_2$ to $C_4$ olefins.

18 Claims, 4 Drawing Sheets

(52) U.S. Cl.
CPC ..... *C10G 2300/301* (2013.01); *C10G 2300/4006* (2013.01); *C10G 2300/4012* (2013.01); *C10G 2400/20* (2013.01); *C10G 2400/30* (2013.01)

(58) Field of Classification Search
CPC ..... C10G 2300/104–1044; C10G 2300/4006; C10G 2400/20; C10G 2400/30
See application file for complete search history.

(56) References Cited

U.S. PATENT DOCUMENTS

| | | | | |
|---|---|---|---|---|
| 4,980,051 | A | 12/1990 | Owen | |
| 7,482,502 | B2 * | 1/2009 | Brown | C07C 4/04 585/652 |
| 8,273,936 | B2 | 9/2012 | Bridges et al. | |
| 9,650,579 | B2 | 5/2017 | Fanget et al. | |
| 2002/0005375 | A1 | 1/2002 | Schlosser et al. | |
| 2005/0261537 | A1 | 11/2005 | Stell et al. | |
| 2006/0116543 | A1 * | 6/2006 | Bellet | C10G 51/023 585/648 |
| 2007/0083071 | A1 * | 4/2007 | Choi | C10G 11/10 585/652 |
| 2009/0054716 | A1 | 2/2009 | Baumgartner et al. | |
| 2010/0239475 | A1 | 9/2010 | Liu et al. | |
| 2012/0130139 | A1 | 5/2012 | Bridges et al. | |
| 2014/0291205 | A1 | 10/2014 | Hartman | |
| 2015/0284646 | A1 | 10/2015 | Fanget et al. | |
| 2016/0097002 | A1 | 4/2016 | Sundaram | |
| 2018/0170832 | A1 * | 6/2018 | Janda | C10G 11/00 |

OTHER PUBLICATIONS

Ren, et al. "Olefins from conventional and heavy feedstocks: Energy use in steam cracking and alternative processes," *Energy*, 2006, 31(4):425-451.

* cited by examiner

METHOD FOR PREHEATING NAPHTHA IN NAPHTHA CATALYTIC CRACKING PROCESSES

CROSS REFERENCE TO RELATED APPLICATIONS

This application is a national phase application under 35 U.S.C. § 371 of International Application No. PCT/IB2018/059012, filed Nov. 15, 2018, which claims benefit of priority of U.S. Provisional Patent Application No. 62/599,557 filed Dec. 15, 2017, the entire content of which are hereby incorporated by reference in their entirety.

FIELD OF INVENTION

The present invention generally relates to the catalytic cracking of naphtha. More specifically, the present invention relates to a particular method of preheating the naphtha prior to cracking.

BACKGROUND OF THE INVENTION

Heavy naphtha catalytic cracking (HNCC) is a process that converts hydrocarbon mixtures with initial boiling point of less than 250° C. to light olefins ($C_2$ to $C_4$) olefins. Benzene, toluene, and xylene (BTX) are also formed in the HNCC process. The process involves contacting the hydrocarbon mixtures with a catalyst at high temperatures and pressures to break the hydrocarbon molecules into smaller and more valuable molecules. One of the challenges with this technology is being able to feed naphtha to the reactor at high temperature, specifically at a temperature close to the reaction temperature (550~700° C.).

BRIEF SUMMARY OF THE INVENTION

A method has been discovered for converting naphtha to olefins that includes pre-heating the naphtha in stages in a plurality of heating units such that the evaporation of the naphtha and the largest temperature increase of the naphtha take place in different heating units. Preheating the naphtha in stages in a plurality of heating units can reduce coke formation and reduce maintenance costs associated with the equipment used in the naphtha catalytic cracking process.

Embodiments of the invention include a method of converting naphtha. The method includes evaporating the naphtha, having an initial boiling point that is less than 250° C., in a first heating unit. The method further includes flowing the evaporated naphtha, at a temperature in a range of 250° C. to 300° C., from the first heating unit to a second heating unit. The method further includes heating the evaporated naphtha in the second heating unit to a temperature of 550° C. to 700° C. and flowing the heated evaporated naphtha from the second heating unit to a reactor. The method further includes providing reaction conditions in the reactor sufficient to convert at least some of the heated evaporated naphtha to $C_2$ to $C_4$ olefins.

Embodiments of the invention include a method of converting naphtha. The method includes evaporating the naphtha, having an initial boiling point that is less than 250° C., in a first heating unit by heating the naphtha to a temperature in a range of 250° C. to 300° C., and flowing the evaporated naphtha, at a temperature in a range of 250° C. to 300° C., from the first heating unit to a second heating unit. The method also includes heating the evaporated naphtha in the second heating unit to a temperature of 550° C. to 700° C.

and flowing the heated evaporated naphtha from the second heating unit to a reactor. The reactor comprises an electric furnace. The method further includes providing reaction conditions in the reactor sufficient to convert at least some of the heated evaporated naphtha to $C_2$ to $C_4$ olefins, wherein providing reaction conditions in the reactor comprises contacting the heated evaporated naphtha with a catalyst.

Embodiments of the invention include a method of evaluating the conversion of naphtha. The method includes evaporating the naphtha in a first heating unit. The naphtha has an initial boiling point that is less than 250° C. and the first heating unit has an internal volume for receiving fluid in a range of 40 $cm^3$ to 50 $cm^3$. The method also includes flowing the evaporated naphtha, at a temperature in a range of 250° C. to 300° C., from the first heating unit to a second heating unit. The second heating unit has an internal volume for receiving fluid in a range of 40 $cm^3$ to 50 $cm^3$. The method further includes heating the evaporated naphtha in the second heating unit to a temperature of 550° C. to 700° C. and flowing the heated evaporated naphtha from the second heating unit to a reactor. The reactor has an internal volume for receiving fluid in a range of 55 $cm^3$ to 65 $cm^3$. The method further includes providing reaction conditions in the reactor sufficient to convert at least some of the heated evaporated naphtha to $C_2$ to $C_4$ olefins and determining a rate of conversion of the naphtha to the $C_2$ to $C_4$ olefins.

The following includes definitions of various terms and phrases used throughout this specification.

The terms "about" or "approximately" are defined as being close to as understood by one of ordinary skill in the art. In one non-limiting embodiment the terms are defined to be within 10%, preferably, within 5%, more preferably, within 1%, and most preferably, within 0.5%.

The terms "wt. %", "vol. %" or "mol. %" refers to a weight, volume, or molar percentage of a component, respectively, based on the total weight, the total volume, or the total moles of material that includes the component. In a non-limiting example, 10 moles of component in 100 moles of the material is 10 mol. % of component.

The term "primarily," as that term is used in the specification and/or claims, means greater than any of 50 wt. %, 50 mol. %, or 50 vol. %. For example, "primarily" may include 50.1 wt. % to 100 wt. % and all values and ranges there between, 50.1 mol. % to 100 mol. % and all values and ranges there between, or 50.1 vol. % to 100 vol. % and all values and ranges there between.

The term "substantially" and its variations are defined to include ranges within 10%, within 5%, within 1%, or within 0.5%.

The terms "inhibiting" or "reducing" or "preventing" or "avoiding" or any variation of these terms, when used in the claims and/or the specification, includes any measurable decrease or complete inhibition to achieve a desired result.

The term "effective," as that term is used in the specification and/or claims, means adequate to accomplish a desired, expected, or intended result.

The use of the words "a" or "an" when used in conjunction with the term "comprising," "including," "containing," or "having" in the claims or the specification may mean "one," but it is also consistent with the meaning of "one or more," "at least one," and "one or more than one."

The words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The process of the present invention can "comprise," "consist essentially of," or "consist of" particular ingredients, components, compositions, etc., disclosed throughout the specification.

Other objects, features and advantages of the present invention will become apparent from the following figures, detailed description, and examples. It should be understood, however, that the figures, detailed description, and examples, while indicating specific embodiments of the invention, are given by way of illustration only and are not meant to be limiting. Additionally, it is contemplated that changes and modifications within the spirit and scope of the invention will become apparent to those skilled in the art from this detailed description. In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

For a more complete understanding, reference is now made to the following descriptions taken in conjunction with the accompanying drawings, in which.

DETAILED DESCRIPTION OF THE INVENTION

Naphtha is a hydrocarbon fraction with a boiling range of 20° C. to 200° C. and with molecules of 4 to 12+ carbon atoms. A method has been discovered for converting naphtha to olefins that includes pre-heating the naphtha in stages in a plurality of heating units such that the evaporation of the naphtha and the largest temperature increase of the naphtha takes place in different heating units. Preheating in stages in a plurality of heating units can reduce coke formation and reduce maintenance costs associated with the naphtha catalytic process.

Figure 1:
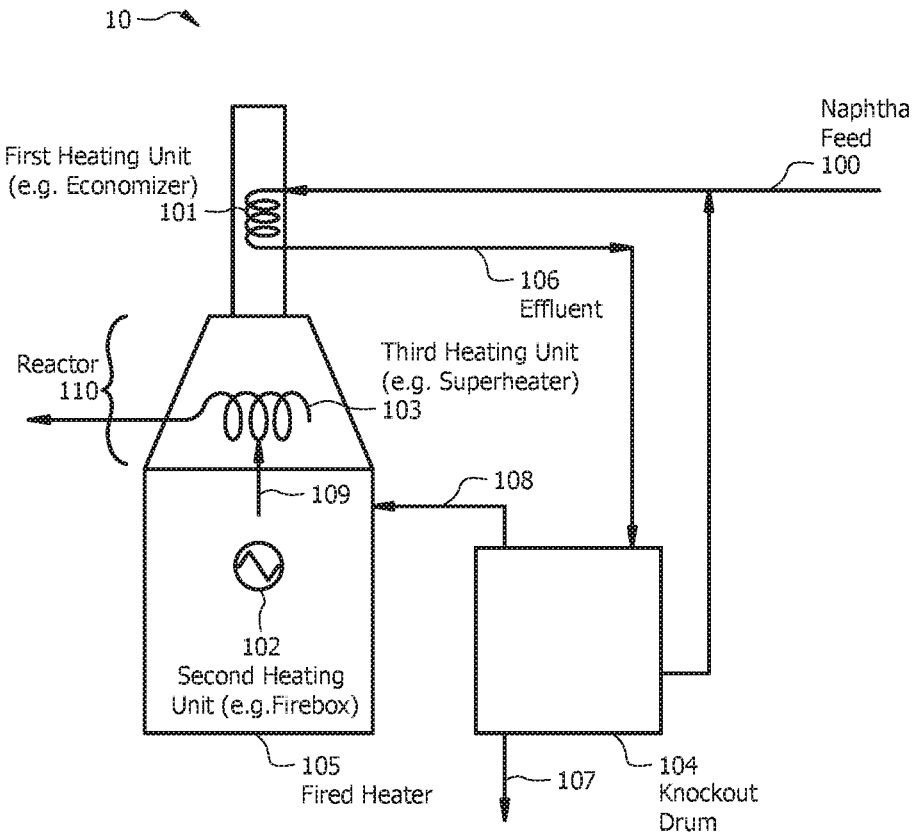
FIG. 1 shows a system for converting naphtha, according to embodiments of the invention.
Figure 2:
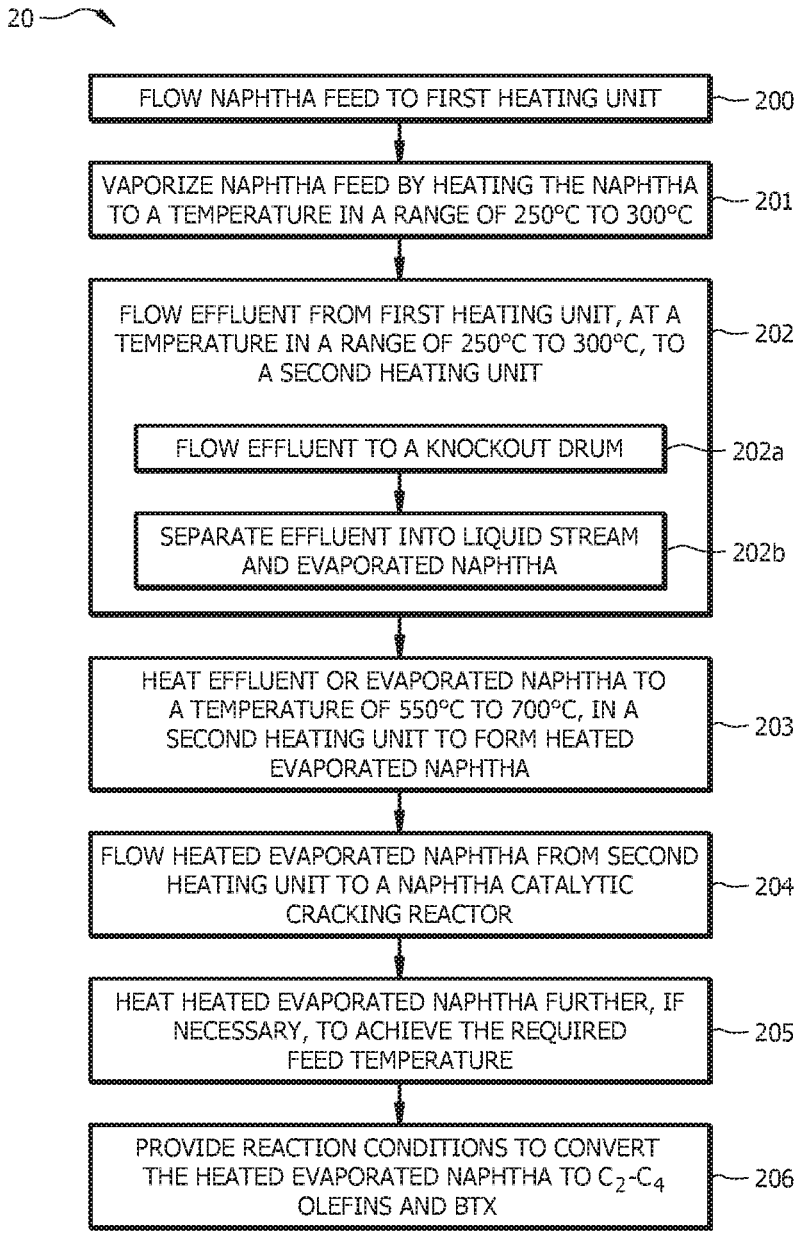
FIG. 2 shows a method for converting naphtha, according to embodiments of the invention.

FIG. 1 shows system 10 for converting naphtha, according to embodiments of the invention. FIG. 2 shows method 20 for converting naphtha, according to embodiments of the invention. Method 20 may be implemented by using system 10.

Method 20, as implemented by system 10, may begin at block 200, which involves flowing naphtha feed 100 to first heating unit 101. In embodiments of the invention, first heating unit 101 comprises an economizer, which includes heating coils (heat exchanger). According to embodiments of the invention, naphtha feed 100 is a mixture of hydrocarbons that has an initial boiling point that is less than 250° C. In embodiments of the invention, first heating unit 101 comprises a heat exchanger in the top section of a fired heater "economizer."

At block 201, in embodiments of the invention, first heating unit 101 vaporizes, partially or completely, naphtha feed 100 by heating the naphtha to a temperature in a range of 250° C. to 300° C. at a pressure of 1 bar to 20 bar, so as to form effluent 106, which comprises evaporated naphtha (and liquid naphtha when there is partial vaporization). According to embodiments of the invention, a liquid film is maintained in heating unit 101, e.g., a liquid film on the economizer's coils. This has the advantage of reducing coke formation inside the coils.

Method 20 may continue at block 202, which involves flowing effluent 106, at a temperature in a range of 250° C. to 300° C., from first heating unit 101 to second heating unit 102. In embodiments of invention, second heating unit 102 comprises a fire box which has a fired furnace.

In embodiments of the invention, effluent 106 is flowed to knockout drum 104 at block 202*a*. And at block 202*b*, knockout drum 104 separates effluent 106 into liquid stream 107 and evaporated naphtha 108. In this way, subsequent high temperature heating units processes only gases. This has the advantage of extending the run length of the furnace and reducing the operation and maintenance cost by minimizing coke formation. At block 203, method 20 involves heating effluent 106 or evaporated naphtha 108 to a temperature of 550° C. to 700° C., in second heating unit 102 to form heated evaporated naphtha 109. According to embodiments of the invention, from knockout drum 104, vapors will flow to second heating unit 102 (e.g., a fire box (convection zone)) of the fired heater 105 to gain the biggest temperature increment of the pre-heating process. In embodiments of the invention, the heated evaporated naphtha is flowed into reactor 110 at a temperature of 550° C. to 700° C. and at a pressure of 0.5 bar to 5 bar.

According to embodiments of the invention, method 20 includes, at block 204, flowing heated evaporated naphtha 109 from second heating unit 102 to naphtha catalytic cracking reactor 110. In embodiments of the invention, heated evaporated naphtha 109 passes through third heating unit 103 (e.g., superheater coils (conduction section)), where heated evaporated naphtha 109 may be heated further, at block 205, if necessary, to achieve the required feed temperature before going to naphtha catalytic cracking reactor 110.

In embodiments of the invention, naphtha catalytic cracking reactor 110 comprises third heating unit 103, such as an electric furnace with superheater coils. According to embodiments of the invention, in naphtha catalytic cracking reactor 110, method 20 involves, at block 205, providing reaction conditions in naphtha catalytic cracking reactor 110 sufficient to convert at least some of the heated evaporated naphtha 109 to $C_2$ to $C_4$ olefins, benzene, toluene, and xylene. In embodiments of the invention, providing reaction conditions at block 206, in naphtha catalytic cracking reactor 110, includes contacting heated evaporated naphtha 109 with a catalyst.

Figure 3:
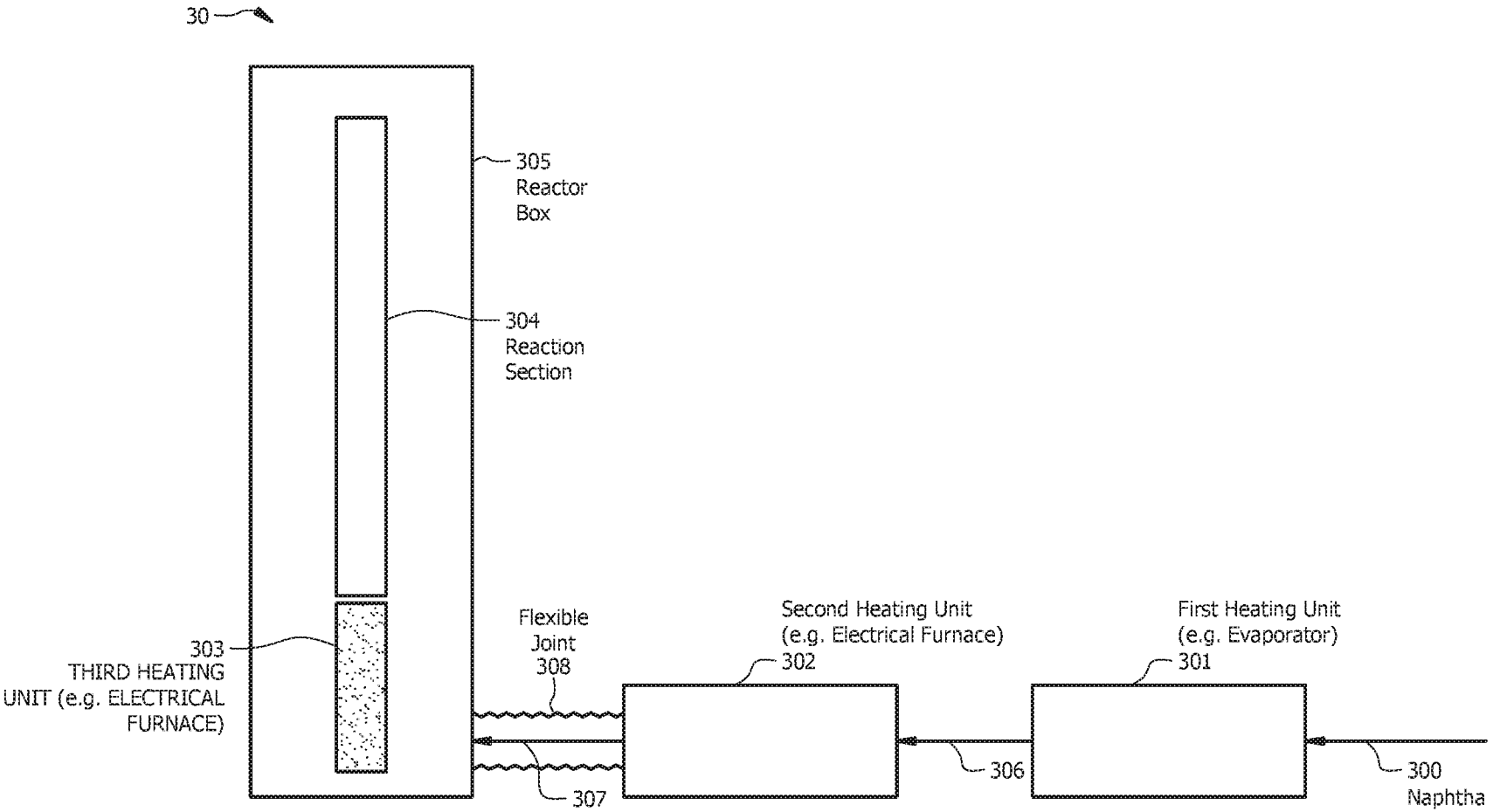
FIG. 3 shows a system for evaluating the conversion of naphtha, according to embodiments of the invention.
Figure 4:
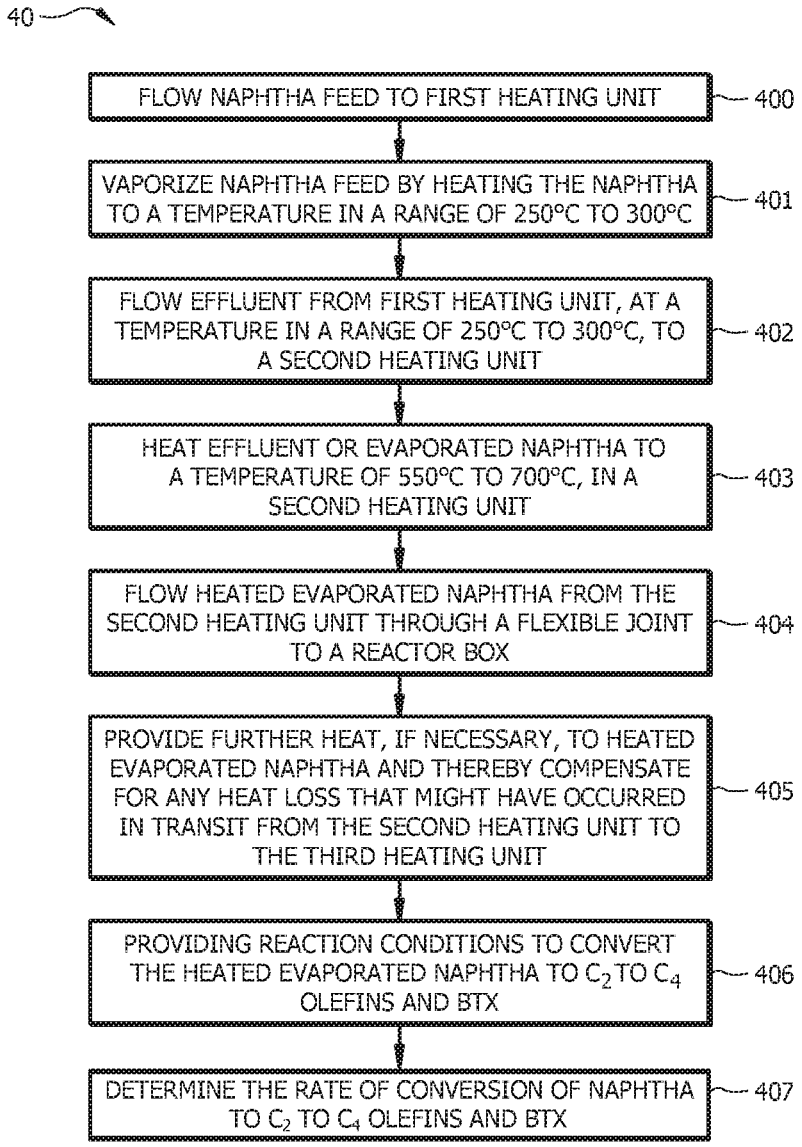
FIG. 4 shows a method for evaluating the conversion of naphtha, according to embodiments of the invention.

FIG. 3 shows system 30 for evaluating the conversion of naphtha, according to embodiments of the invention. System 30 may be a laboratory unit or a pilot scale unit. FIG. 4 shows method 40 for evaluating the conversion of naphtha, according to embodiments of the invention. Method 40 may be implemented by using system 30.

Method 40, as implemented by system 30, may begin at block 400, which involves flowing naphtha feed 300 to first heating unit 301. The capacity (volume) of first heating unit 301 is in a range 40 $cm^3$ to 50 $cm^3$. In embodiments of the invention, first heating unit 301 comprises an evaporator, which comprises an electrical furnace.

According to embodiments of the invention, naphtha feed 300 is a mixture of hydrocarbons that has an initial boiling point that is less than 250° C. In embodiments of the invention, first heating unit 301 comprises an evaporator. At block 401, in embodiments of the invention, first heating unit 301 vaporizes, partially or completely, naphtha feed 300 by heating the naphtha to a temperature in a range of 250° C. to 300° C. at a pressure of 1 bar to 10 bar, so as to form effluent 306, which comprises evaporated naphtha (and liquid naphtha when there is partial vaporization).

Method 40 may continue at block 402, which involves flowing effluent 306, at a temperature in a range of 250° C. to 300° C., from first heating unit 301 to second heating unit 302. In embodiments of invention, second heating unit 302 comprises an electrical furnace. The capacity (volume) of second heating unit 302 is in a range 40 $cm^3$ to 50 $cm^3$.

At block 403, method 40 involves heating effluent 306 to a temperature of 550° C. to 700° C., in second heating unit 302 to form heated evaporated naphtha 307. In some embodiments of the invention, heated evaporated naphtha 307 is flowed into reactor box 305 at a temperature of 550° C. to 700° C. and at a pressure of 0.5 bar to 5 bar. The capacity (volume) of reactor box 305 is in a range 55 $cm^3$ to 65 $cm^3$.

According to embodiments of the invention, method 40 includes, at block 404, flowing heated evaporated naphtha 307 from second heating unit 302 through flexible joint 308 to reactor box 305. Flexible joint 308, according to embodiments of the invention, is adapted so that it is easily removable for cleaning purposes if coke or any other residue accumulates inside it. In embodiments of the invention, reactor box 305 comprises third heating unit 303, such as an electrical furnace. At block 405, third heating unit 303 is used to provide heat, if necessary, to heated evaporated naphtha 307 and thereby compensate for any heat loss that might have occurred in transit from the second heating unit to the third heating unit.

According to embodiments of the invention, in reactor box 305, method 40 involves, at block 406, providing reaction conditions in reactor box 305 (at reaction section 304) sufficient to convert the heated evaporated naphtha 307 to $C_2$ to $C_4$ olefins, benzene, toluene, and xylene. In embodiments of the invention, providing reaction conditions at block 406, in reactor box 305, comprises contacting heated evaporated naphtha 307 with a catalyst. In embodiments of the invention, the distance between the heating units are minimized so as to avoid heat loss.

At block 407, method 40, in embodiments of the invention, involves determining a rate of conversion of the naphtha to the $C_2$ to $C_4$ olefins. This determination may be done by various methods, for example, by calculating the average conversion of the feed components.

Although embodiments of the present invention have been described with reference to blocks of FIG. 2 and FIG. 4, it should be appreciated that operation of the present invention is not limited to the particular blocks and/or the particular order of the blocks illustrated in FIG. 2 and FIG. 4. Accordingly, embodiments of the invention may provide functionality as described herein using various blocks in a sequence different than that of FIG. 2.

In the context of the present invention, embodiments 1-19 are described. Embodiment 1 is a method of converting naphtha. The method includes evaporating the naphtha in a first heating unit, wherein the naphtha has an initial boiling point that is less than 250° C. and flowing the evaporated naphtha, at a temperature in a range of 250° C. to 300° C., from the first heating unit to a second heating unit. The method also includes heating the evaporated naphtha in the second heating unit to a temperature of 550° C. to 700° C., flowing the heated evaporated naphtha from the second heating unit to a reactor, and providing reaction conditions in the reactor sufficient to convert at least some of the heated evaporated naphtha to $C_2$ to $C_4$ olefins. Embodiment 2 is the method of embodiment 1, wherein the naphtha in the first heating unit is heated to a temperature in a range of 250° C. to 300° C. at a pressure of 1 bar to 20 bar. Embodiment 3 is the method of either of embodiments 1 and 2, wherein the reactor includes a third heating unit. Embodiment 4 is the method of any of embodiments 1 to 3, wherein providing reaction conditions in the reactor includes contacting the heated evaporated naphtha with a catalyst. Embodiment 5 is the method of any of embodiments 1 to 4, wherein some of the heated evaporated naphtha is converted to benzene, toluene, and xylene. Embodiment 6 is the method of any of embodiments 1 to 5, wherein the heated evaporated naphtha is flowed into the reactor at a temperature of 550° C. to 700° C. and at a pressure of 0.5 bar to 5 bar. Embodiment 7 is the method of any of embodiments 1 to 6 further including flowing effluent of the first heating unit to a knockout drum, and separating the effluent of the first heating unit into a liquid stream and a stream comprising the evaporated naphtha. Embodiment 8 is the method of any of embodiments 1 to 7, wherein the first heating unit is an economizer, which includes heating coils. Embodiment 9 is the method of any of embodiments 1 to 8, wherein the second unit is a fire box, which includes a fired furnace.

Embodiment 10 is a method of evaluating conversion of naphtha. The method includes evaporating the naphtha in a first heating unit, wherein the naphtha has an initial boiling point that is less than 250° C., and wherein the first heating unit has an internal volume for receiving fluid in a range of 40 $cm^3$ to 50 $cm^3$. The method also includes flowing the evaporated naphtha, at a temperature in a range of 250° C. to 300° C., from the first heating unit to a second heating unit, wherein the second heating unit has an internal volume for receiving fluid in a range of 40 $cm^3$ to 50 $cm^3$. In addition, the method includes heating the evaporated naphtha in the second heating unit to a temperature of 550° C. to 700° C., flowing the heated evaporated naphtha from the second heating unit to a reactor, wherein the reactor has an internal volume for receiving fluid in a range of 55 $cm^3$ to 65 $cm^3$, providing reaction conditions in the reactor sufficient to convert at least some of the heated evaporated naphtha to $C_2$ to $C_4$ olefins, and determining a rate of conversion of the naphtha to the $C_2$ to $C_4$ olefins. Embodiment 11 is the method of embodiment 10, wherein the evaporated naphtha is flowed from the first heating unit through a flexible joint to the second heating unit. Embodiment 12 is the method of either of embodiments 10 and 11, wherein the naphtha in the first heating unit is heated to a temperature in a range of 250° C. to 300° C. at a pressure of 1 bar to 10 bar. Embodiment 13 is the method of any of embodiments 10 to 12, wherein the reactor includes a third heating unit. Embodiment 14 is the method of any of embodiments 10 to 13, wherein providing reaction conditions in the reactor includes contacting the heated evaporated naphtha with a catalyst. Embodiment 15 is the method of any of embodiments 10 to 14, wherein some of the heated evaporated naphtha is converted to benzene, toluene, and xylene. Embodiment 16 is the method of any of embodiments 10 to 15, wherein the heated evaporated naphtha is flowed into the reactor at a temperature of 550° C. to 700° C. Embodiment 17 is the method of any of embodiments 10 to 16, wherein the first heating unit is an evaporator, which includes an electrical furnace. Embodiment 18 is the method of any of embodiments 10 to 17, wherein the second heating unit includes an electrical furnace. Embodiment 19 is the method of any of embodiments 10 to 18, wherein the third heating unit includes an electrical furnace.

Although embodiments of the present application and their advantages have been described in detail, it should be understood that various changes, substitutions and alterations can be made herein without departing from the spirit and scope of the embodiments as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the above disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A method of converting naphtha, the method comprising:

evaporating the naphtha in a first heating unit, wherein the naphtha has an initial boiling point that is less than 250° C.;

flowing the evaporated naphtha, at a temperature in a range of 250° C. to 300° C., from the first heating unit to a second heating unit;

heating the evaporated naphtha in the second heating unit to a temperature of 550° C. to 700° C.;

flowing the heated evaporated naphtha from the second heating unit to a reactor; and providing reaction conditions in the reactor sufficient to convert at least some of the heated evaporated naphtha to $C_2$ to $C_4$ olefins;

wherein providing reaction conditions in the reactor comprises contacting the heated evaporated naphtha with a catalyst; and wherein some of the heated evaporated naphtha is converted to benzene, toluene, and xylene.

2. The method of claim 1, wherein the naphtha in the first heating unit is heated to a temperature in a range of 250° C. to 300° C. at a pressure of 5 bar to 20 bar.

3. The method of claim 2, wherein the pressure ranges from 10 bar to 20 bar.

4. The method of claim 1, wherein the reactor comprises a third heating unit.

5. The method of claim 1, wherein the naphtha is completely evaporated.

6. The method of claim 1, wherein the heated evaporated naphtha is flowed into the reactor at a temperature of 550° C. to 700° C. and at a pressure of 0.5 bar to 5 bar.

7. The method of claim 1, further comprising the steps of:

flowing effluent of the first heating unit to a knockout drum; and separating the effluent of the first heating unit into a liquid stream and a stream comprising the evaporated naphtha.

8. The method of claim 1, wherein the first heating unit is an economizer, which comprises heating coils.

9. The method of claim 1, wherein the second unit is a fire box, which comprises a fired furnace.

10. The method of claim 1, wherein the reactor is a reactor box and the heated evaporated naphtha is flowed from the second heating unit to the reactor through a flexible joint, and wherein reaction conditions in reactor box are sufficient to convert the heated evaporated naphtha to the C2 to C4 olefins and also to benzene, toluene, and xylene.

11. A method of evaluating conversion of naphtha, the method comprising:

evaporating the naphtha in a first heating unit, wherein the naphtha has an initial boiling point that is less than 250° C., wherein the first heating unit has an internal volume for receiving fluid in a range of 40 $cm^3$ to 50 $cm^3$;

flowing the evaporated naphtha, at a temperature in a range of 250° C. to 300° C., from the first heating unit to a second heating unit, wherein the second heating unit has an internal volume for receiving fluid in a range of 40 $cm^3$ to 50 $cm_3$;

heating the evaporated naphtha in the second heating unit to a temperature of 550° C. to 700° C.;

flowing the heated evaporated naphtha from the second heating unit to a reactor, wherein the reactor has an internal volume for receiving fluid in a range of 55 $cm^3$ to 65 $cm^3$;

providing reaction conditions in the reactor sufficient to convert at least some of the heated evaporated naphtha to $C_2$ to $C_4$ olefins; and determining a rate of conversion of the naphtha to the $C_2$ to $C_4$ olefins;

wherein providing reaction conditions in the reactor comprises contacting the heated evaporated naphtha with a catalyst; and wherein some of the heated evaporated naphtha is converted to benzene, toluene, and xylene.

12. The method of claim 11, wherein the evaporated naphtha is flowed from the first heating unit through a flexible joint to the second heating unit.

13. The method of claim 11, wherein the naphtha in the first heating unit is heated to a temperature in a range of 250° C. to 300° C. at a pressure of 5 bar to 10 bar.

14. The method of claim 11, wherein the reactor comprises a third heating unit.

15. The method of claim 11, wherein the heated evaporated naphtha is flowed into the reactor at a temperature of 550° C. to 700° C.

16. The method of claim 11, wherein the first heating unit is an evaporator, which comprises an electrical furnace.

17. The method of claim 11, wherein the second heating unit comprises an electrical furnace.

18. The method of claim 14, wherein the third heating unit comprises an electrical furnace.

* * * * *